United States Patent [19]

Trubody et al.

[11] 4,154,442

[45] May 15, 1979

[54] TENNIS COURT CONTROL SYSTEM

[75] Inventors: Bert M. Trubody, Taylorsville; William W. White, Los Gatos; David R. Vonasek, Milpitas, all of Calif.

[73] Assignee: Patterson-Williams Manufacturing Co., Santa Clara, Calif.

[21] Appl. No.: 879,018

[22] Filed: Feb. 17, 1978

[51] Int. Cl.[2] ..... A63B 61/00

[52] U.S. Cl. ..... 273/29 R; 211/13

[58] Field of Search ..... 273/29 R; 116/120; 211/13, 14, 60 T, 49 R, 49 D, 19, 133; 40/128, 129 R; 35/39

[56] References Cited

U.S. PATENT DOCUMENTS

| | | | |
|---|---|---|---|
| 763,109 | 6/1904 | Parnall | 211/133 |
| 2,289,751 | 7/1942 | Brenholt | 211/49 R |
| 2,629,186 | 2/1953 | Biddlestone | 35/39 |
| 3,203,553 | 8/1965 | Pendergrast, Jr. et al. | 211/19 |

*Primary Examiner*—Richard C. Pinkham
*Assistant Examiner*—T. Brown
*Attorney, Agent, or Firm*—Townsend and Townsend

[57] ABSTRACT

A device for controlling the amount of time players occupy each of a plurality of tennis courts, while showing waiting players how long they must wait and which of the waiting players is to get the next available court. A central board has two dials for each court, one dial being set for the time when play is begun and the other dial being set for the time that the court will become available. The board has a sloping rack into which a tennis racket is placed by a member of each group waiting to play. Gravity tends to draw the sequentially placed rackets downward with the racket occupying the most downward position signifying the identity of the person who is to get the next available court. By inspection of the dials, the waiting players can tell when each of the courts is to become available.

9 Claims, 3 Drawing Figures

TENNIS COURT CONTROL SYSTEM

BACKGROUND OF THE INVENTION

Tennis has become an increasingly popular sport in recent years, and many new courts have been constructed. However, the construction has not kept up with the demand, and the number of players wishing to use the courts at a given time typically exceeds the number of courts available. Thus it is necessary to fairly and effectively allocate court time. Within this broad context of excess demand, several specific problems have presented themselves.

First, is the problem of maintaining numerical or sequential order among a plurality of waiting players. The normal rule is that available courts are allocated to players on a first come-first served basis. It is important that a court control system accomplish this ordering very effectively, so as to avoid disputes among waiting players. Aside from equitable considerations that demand this outcome, disputes and haggling over position tend to result in a non-negligible of idle time for the courts while players are waiting. Moreover, a system that is unreliable tends to be disregarded by many.

Second, in order to make sure that each of the limited number of tennis courts is in use substantially all of the time, it is important to make sure that the waiting player whose turn it is to play next is present to take over the court as soon as it becomes available.

A third problem, related to the second in being the logical opposite, is presented by overeager players awaiting a court. Since the courts, by virtue of their size are spread about, the waiting players are forced to continually monitor the courts to determine when a court becomes free. In order to make the inquiry more effective, the waiting players are likely to ask those players using the court when they will be through, thereby bothering them.

Fourth, is the problem of imposing time limits on court usage. If no such time limits are in effect, waiting players have virtually no way of determining in advance how long a wait is in store for them. Once time limits have been established, it remains a problem to insure that players abide by them.

There exists a prior art court control system that is responsive to all these problems. Broadly, it involves having an attendant present at all times. This attendant keeps track of waiting players, courts in use, and appropriate time limits. While an attendant-based system is reasonable for a tennis facility where the players pay to play, since the attendant would have to be present to collect the money anyway, it is particularly unsuitable for a public tennis facility due to the expense of maintaining a person on the premises.

A basic approach that seeks to emulate the attendant, without the attendant, makes use of a chalkboard wherein arriving players enter their names on a list and players using a court signify on the board when they are going to be finished with the court. Thus, the players themselves theoretically accomplish the function of the attendant. However, such chalkboard-based systems, while sound in theory, have proven to be highly ineffective in practice. One of the prime reasons for this is the fact that the chalk itself is easily lost or stolen. Moreover, exposure to the elements results in the chalk's becoming wet and unfit for use. Additionally, an eraser must be provided to maintain the information on the board in a relatively legible state. Erasers, like chalk, are easily lost, stolen, or damaged. Pranksters are also a problem, since it is very easy matter to simply erase all the information that is on the board. Vandals are a further problem since the chalkboards are easily defaced.

Another way of maintaining order among a group of waiting tennis players is to provide a chute into which an arriving player places a tennis ball. A first come-first served system is maintained with the balls in the chute providing a visual display of the relative priorities among the waiting players. This system avoids most of the difficulties of the chalkboard system, but provides less information. In particular, no information regarding time of availability of the various is maintained or displayed. A problem shared with the chalkboard system is that there is nothing to tie a waiting player to the tennis court area, since a tennis ball is an item of little value. Thus, waiting players tend to arrive, deposit a tennis ball, and depart, trying to estimate when their court will become available. In the event that the guess is inaccurate and that a court becomes available for that player when that player is not present, that player may lose his turn entirely or have his tennis ball placed in the chute in the rearmost position.

An attempt to avoid this latter difficulty makes use of tennis rackets rather than tennis balls as markers signifying player priority. Thus, prior art tennis court control systems have incorporated a board having a plurality of pegs, each of which is adapted to have a tennis racket hung therefrom. A system such as this has the problem that all the tennis rackets need to be moved periodically as players at the front of the line remove their rackets to commence playing. The increased handling of the tennis rackets increases the chance of the rackets getting mixed up, or worse yet, damaged.

SUMMARY OF THE INVENTION

The present invention is a tennis court control system that maintains order among a group of waiting players, tends to insure that the player next in line is physically present when a court is available for him, provides information on the future availability of all the courts so that waiting players do not bother players using the courts, and incorporates time limits into its operation in a natural way. The system avoids making use of either an attendant or a chalkboard, and is highly resistant to vandalism.

Broadly, the invention comprises a centrally located board having two dials for each tennis court, and a sloping rack into which an arriving player places his tennis racket. The rack sequentially feeds the rackets placed therein on a first-in-first-out basis so that the racket of the player whose arrival was earliest is fed first indicating that player's top priority. A waiting player need only look at the rack to see what position his racket occupies in order to know his relative priority. Each of the two dials for each court is graduated in hours like a clock face, and has a manually settable pointer. When play on the court is begun, one dial is set for the time at which play is begun and the other for the time that the court is to become available, consistent with any time limits in effect. A waiting player need only glance at the board to see the status of each and every court. Adherence to posted limits is easily checked by waiting players.

In order for the rack to accomplish the desired feeding of tennis rackets placed therein, it is desirable that the tennis rackets are easy to place in the rack and easy to withdraw from it. Moreover, it is important that rackets placed within the rack are not subject to falling out. The rack employs two sloping struts spaced apart by a dimension slightly greater than the width of a tennis racket handle to accommodate the handle of the tennis racket but prevent the head from passing therethrough. Two horizontal strouts, spaced more closely, accommodate the handle but prevent sideways motion. A relatively non-slippery coating on at least the sloping struts decreases the likelihood of a racket's being accidentally rotated through 90° and falling out of the rack. In addition, the coating makes it easier to withdraw a tennis racket from the rack since the other rackets above the one being withdrawn are not immediately forced against it. At the same time, such reduced friction will not prevent a general downward migration of the rackets placed in the rack.

Ease of withdrawal is also facilitated by a sloping plate between the sloping struts, the plate lying generally in a plane perpendicular to the direction of the sloping strouts. The plate has two end portions that are sloped away from the rackets so as to allow the withdrawal of the racket against the plate without snagging.

The manually settable pointers have to be rotatable without jamming while at the same time being tight enough to maintain the position at which they were set. Spring washers between the pointer and the dial face, and a lock nut and flat washer behind the board provide a pointer which does not jam and yet does not become loose and unreliable. Thus the use expensive bearings is avoided.

Other objects, features, and advantages will become clearer upon reading the remainder of this specification with reference to the attached drawings.

DESCRIPTION OF THE PREFERRED EMBODIMENT

Figure 1:
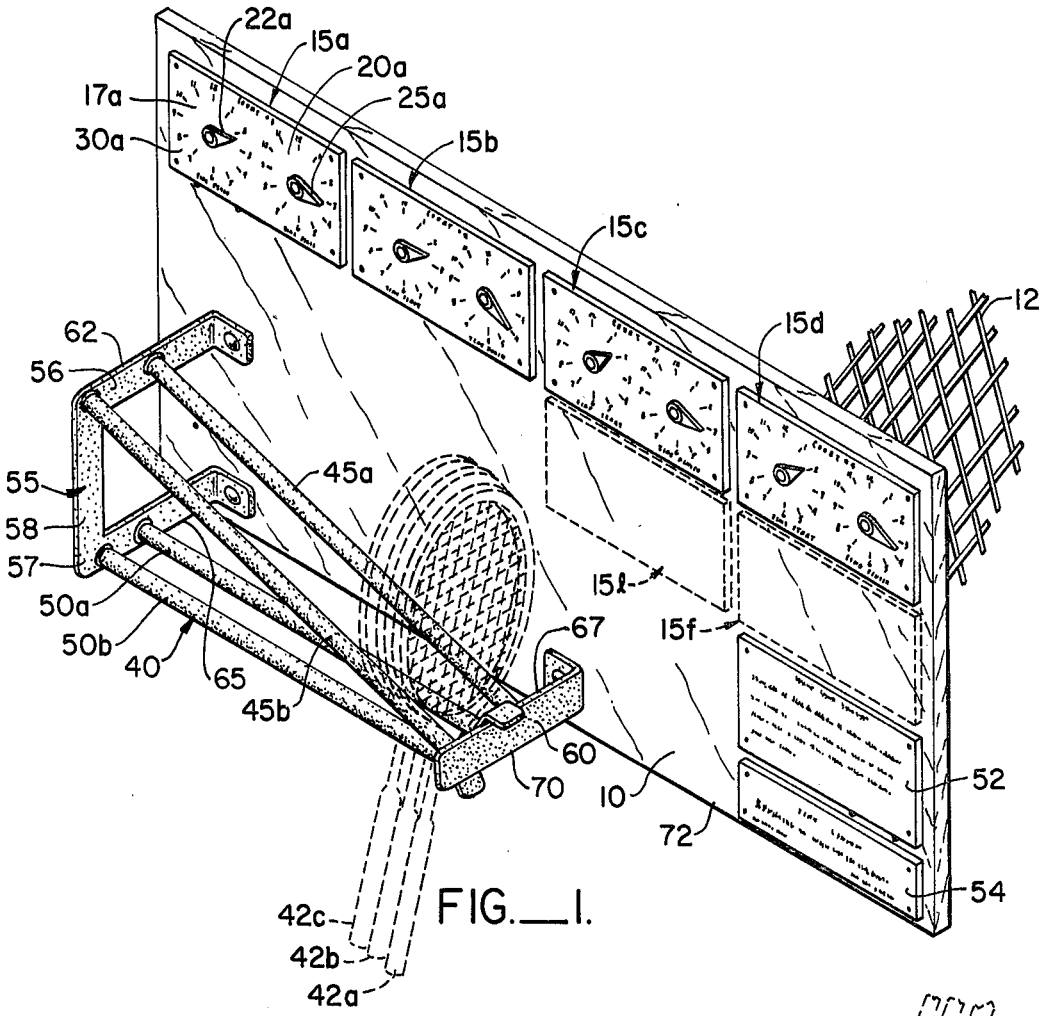
FIG. 1 is a perspective view of an embodiment of the invention suitable for controlling access to four tennis courts. In the situation illustrated, all four courts are in use, and three people are waiting to play.

FIG. 1 is an overall perspective view showing the construction and operation of the invention. Board 10 is adapted to be mounted upon chain link fence 12 at a central location of a tennis court complex. Standard mounting hardware is used. Board 10 may be constructed out of $\frac{3}{4}''$ plywood and is typically $2' \times 4'$ in size. A plurality of court indicators 15*a*, 15*b*, 15*c*, and 15*d* is mounted on board 10. The embodiment illustrated, having four court indicators, is suitable for use in a complex with four courts. Court indicator 15*a* comprises paired dial faces 17*a* and 20*a*, with corresponding pointers 22*a* and 25*a*. In the preferred embodiment, dial faces 17*a* and 20*a* are marked on a single plate 30*a*. Plate 30*a* is preferably constructed from cast aluminum with the dial marking being either depressed or raised from the surface. Plastic dial faces would be suitable also, but might possibly tend to invite vanalism due to their apparent fragility. Plate 30*a* is preferably mounted to board 10 with standard tamper-proof hardware. Court indicators 15*b*, 15*c*, and 15*d* are of identical construction to court indicator 15*a* except that each is marked for a different court.

A single rack 40 is mounted to board 10 to hold a plurality of tennis rackets 42*a*, 42*b*, and 42*c*, corresponding to a plurality of waiting players. Rack 40 has paired sloping struts 45*a* and 45*b*, and paired horizontal struts 50*a* and 50*b*. The spacing between sloping struts 45*a* and 45*b* is approximately $3\frac{1}{4}$ inches to accommodate the handle of a tennis racket and enough of the head so that the tennis racket does not tend to rotate about its handle. The spacing of the struts 50*a* and 50*b* is approximately $1\frac{3}{4}$ inches, which is sufficient to accommodate the handle of a tennis racket while at the same time preventing movement in the plane of the tennis racket. Each tennis racket is thus held in rack 40 with its plane perpendicular to the plane of board 10. Since struts 45*a*, 45*b*, 50*a*, and 50*b* are all in planes parallel to the plane of board 10, the line of waiting rackets extends in a plane parallel to that of board 10, thereby avoiding any undue protrusion.

Instruction plate 52 and time limit plate 54 (if required) are typically affixed to board 10. Plates 52 and 54 are preferably aluminum castings constructed in a manner similar to that of dial plate 30*a*.

Figure 2:
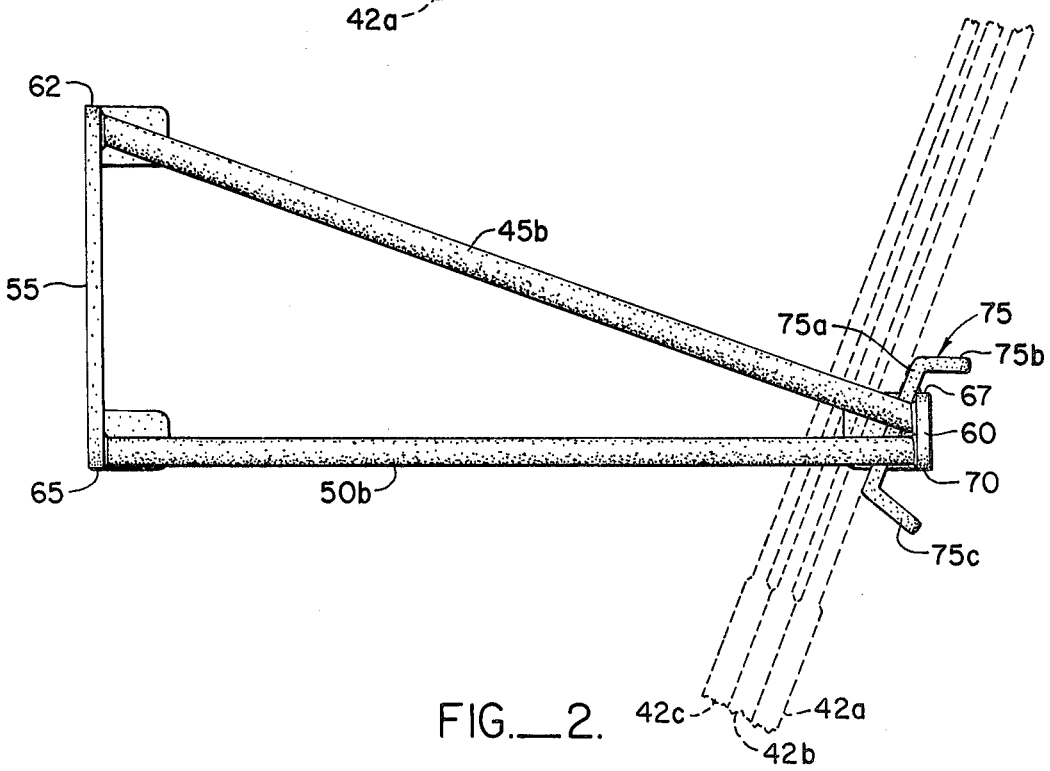
FIG. 2 is a front view of the rack.

The construction of rack 40 is best understood with reference to FIGS. 1 and 2. Thus, it can be seen that struts 45*a*, 45*b*, 50*a*, and 50*b* are maintained in their spaced relationship from board 10 by tall bracket 55 and short bracket 60, both of which extend outward from the plane of board 10. Bracket 55 may actually be constructed so as to comprise paired upper and lower brackets 56 and 57 spaced apart at their ends remote from board 10 by vertical member 58. While any suitable material could be used to construct the rack, considerations of making the device relatively immune to vandalism dictate a rather sturdy construction. Therefore, brackets 55 and 60 are preferably 3/16″ steel while struts 45*a*, 45*b*, 50*a*, and 50*b* are preferably schedule 40 galvanized steel pipe of $\frac{1}{2}''$ inner diameter (approximately $\frac{7}{8}''$ outer diameter). Rack 40 is of one piece construction, the struts being welded to the brackets. Brackets 55 and 60 are bolted to board 10. To make rack 40 relatively non-removable from board 10, the mounting bolts may have their ends peened after the rack is in place.

Bracket 55 has an upper edge 62 and a lower edge 65; bracket 60 has an upper edge 67 and a lower edge 70. Lower edges 65 and 70 are aligned parallel to and relatively close to the bottom edge 72 of board 10. Sloping struts 45*a* and 45*b* are attached to bracket 55 near upper edge 62 and to bracket 60 near upper edge 67. Horizontal struts 50*a* and 50*b* are attached to brackets 55 and 60 near lower edges 65 and 70 respectively. The angle of slope is preferably in the range of 20° to 25° from the horizontal.

Bracket 40 is fitted with a racket stop 76 which comprises central plate portion 75*a*, and angled end portions 75*b* and 75*c*. Racket stop 75 is located between struts 50*a* and 50*b* (and hence between struts 45*a* and 45*b*) near the point at which they join bracket 60. The orientation of racket stop 75 is such that its central plate portion 75*a* is generally perpendicular to the direction of sloping struts 45*a* and 45*b*. Thus, an angle of 67° from the horizontal would be typical. Angled portions of 75*b* and 75*c* extend away from central plate portion 75*a* in a direction away from the struts. Thus, end portions 75*b* and 75*c* extend away from tennis rackets in the rack which generally confront central plate portion 75*a*.

Rack 40 is preferably coated with a somewhat non-slippery coating such as vinyl in order that tennis rackets placed within rack 40 not be entirely free to slide. In this way, when a player withdraws his racket from the rack, the rackets that are higher up do not bear against the racket being withdrawn thereby impeding its withdrawal. The rackets within the rack do tend to settle to the bottom in any case, since a player putting his racket at the top end of the line will almost invariably push his racket against the others, causing the rackets to settle downward. Actually, it is in the interest of waiting players to compact the line so that it is difficult for an arriving player to place his racket out of sequence.

Given that the rackets in rack 40 are found to be compacted against one another, it can be seen that lower angled end portion 75*c* of racket stop 75 provides a useful bearing surface for allowing the withdrawal of the tennis racket lowest in the rack. In particular, it prevents the wider portions of the handle of the racket undergoing withdrawal from snagging on bracket 60.

Figure 3:
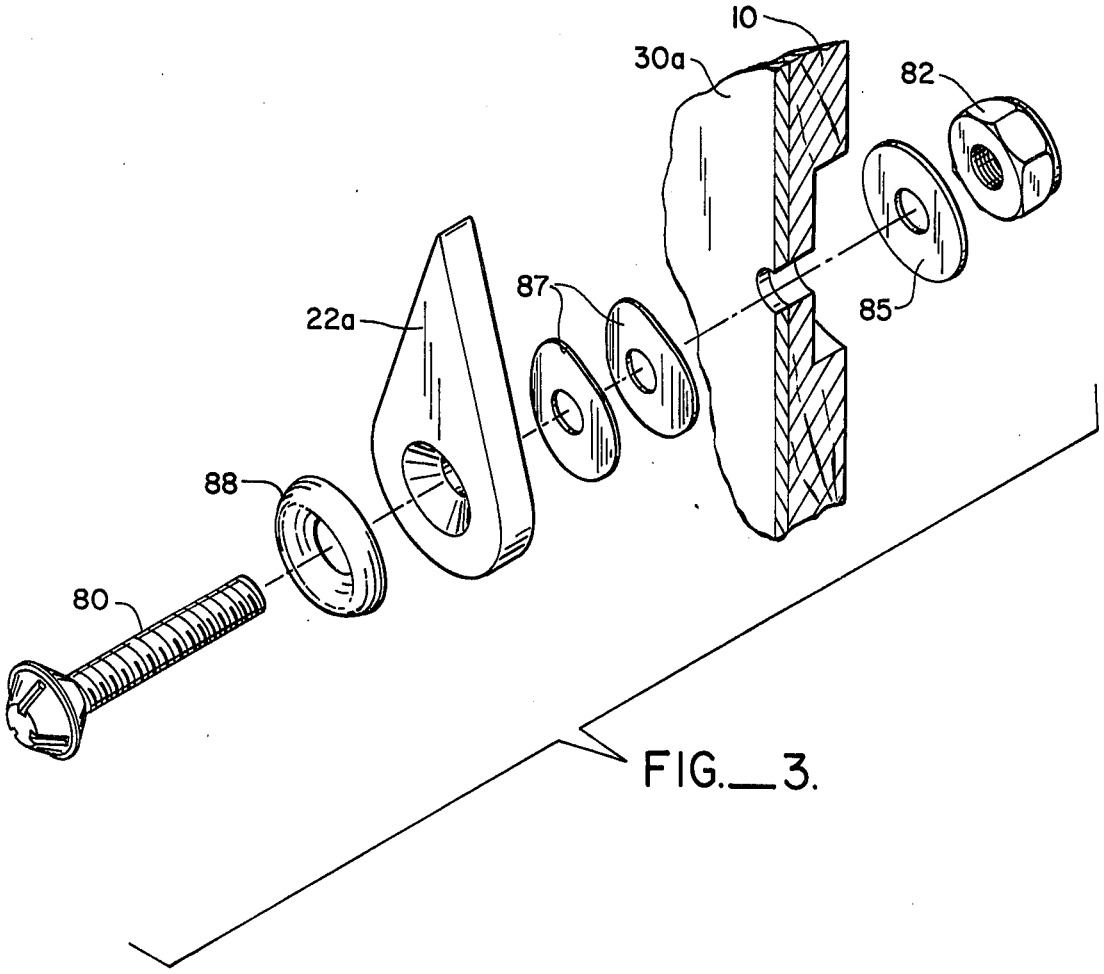
FIG. 3 is an exploded perspective of one of the pointer assemblies.

FIG. 3 illustrates the construction of the manually settable dial indicators, particularly pointer 22*a* on court indicator 15*a*. Pointer 22*a* itself is preferably punched from ¼" thick 6061-T6 aluminum in order to provide ruggedness. Pointer 22*a* is mounted to dial face 30*a* by bolt 80 which extends through dial face 30*a* and through board 10, and lock nut 82. Flat washer 85 is located between board 10 and lock nut 82; spring washers 87 are located between pointer 22*a* and dial face 30*a;* and finishing washer 88 is located between pointer 22*a* and the head of bolt 80. Pointer 22*a* may be countersunk to accommodate the head of bolt 80. Pointer 22*a,* bolt 80, and lock nut 82 form a rigid unit with none of the parts rotatable relative to one another. Rather, dial plate 30*a* and flat washer 85 provide paired bearing surfaces for smooth rotation. At the same time, spring washers 87 prevent the pointer from becoming so loose as to fail to maintain a set indication. Finishing washer 88 is for cosmetic purposes.

Having set forth the structure of the invention, the operation can now be described. This is best done with reference again to FIG. 1. Instruction plate 52 carries instructions on the use of the court order system of this invention. A typical set of instructions reads as follows:

"1. Place racket in the metal holder to left of other rackets.
2. When your racket reaches the right hand side, check board to see which court will be free next.
3. When the time expires on the first court up, set starting time on left hand dial and finish time on right hand dial of clock governing the free court, and begin play on the court."

In order to ensure that players use the court control system, board 10 is preferably painted a bright color (e.g. yellow), and signs directing use of the system are placed at all entrances to the tennis court complex.

The device illustrated in FIG. 1 is an embodiment for controlling access to four courts. Two additional courts could be controlled by the addition of additional court indicators 15*e* and 15*f* (shown in phantom outline). Additional court indicators beyond six would necessitate the use of a taller board. If there are more than eight courts, it is preferable to divide the courts and use two separate boards. As shown, three players are awaiting use of the court, and indicated by the three rackets 42*a,* 42*b,* and 42*c* in rack 40.

For particularlity, assume that the time at which the device is in the condition illustrated is approximately 2:35. Further, assume that the time limits in effect are ¾ hour for singles and 1¼ hour for doubles. A survey of court indicators 15*a,* 15*b,* 15*c,* and 15*d* is sufficient to show status of courts 1, 2, 3, and 4 respectively. Pointer 22*a* is set at 2:15; pointer 25*a* is set at 3:00. This indicates that singles play on court 1 began at 2:15 and that court 1 will become free at 3:00. Similarly, court indicator 15*b* indicates that doubles play on court 2 began at 2:30 and that court 2 will become free at 3:45. Court indicator 15*c* shows that doubles play began on court 3 at 1:45 and that court 3 will become free at 3:00. In a like fashion, court indicator 15*d* indicates that doubles play on court 4 began at 2:00 and that court 4 will become available at 3:15.

Thus, the owner of racket 42*a* knows that he will be able to play on court 1 or 3 at 3:00; the owner or racket 42*b* knows that he will be able to play on court 1 or 3 at 3:00; the owner of racket 42*c* knows that he will be able to play on court 4 at 3:15. The next player to arrive and place his racket in the rack will be able to play on court 2 at 3:45, unless another court becomes available earlier.

We claim:

1. A centrally located device for allocating to a sequence of waiting users one of a plurality of tennis courts, each of which courts in general becomes available at a different time, comprising: a board; a sloping rack mounted on the board for sequentially feeding a plurality of rackets placed therein on a first-in-first-out basis wherein each waiting player upon arrival at the tennis courts places a racket therein, whereby the racket of the player whose arrival was earliest is fed first, indicating that player's top priority for the next available court; and court availability display means for each court for displaying the time at which the court will become available for use by one of the waiting players, the court availability display means having a dial graduated in time, and a manually settable pointer wherein a player commencing use of the court sets the time at which the court will become available for a waiting player by manually grasping the pointer and turning it so that it points to the time at which the court will become available.

2. The invention of claim 1 also having means for each court displaying the time at which that court most recently became occupied.

3. The invention of claim 1 wherein the sloping rack comprises paired sloping struts, each having an upper end and a lower end, the struts being spaced apart by a distance larger than the maximum transverse dimension of a tennis racket handle, and smaller than the maximum transverse dimension of a tennis racket head, whereby a tennis racket placed between the struts is supported by its head with its handle hanging below the struts; whereby a racket placed between the struts tends to migrate toward the lower end of the struts.

4. The invention of claim 3 wherein the rack also comprises racket stopping means mounted between the struts at their lower ends, the racket stopping means confronting the racket occupying the lowest position in the rack, and facilitating the withdrawal of the racket when other rackets are present.

5. The invention of claim 1 also comprising a bolt for mounting the pointer to the dial, and a spring washer between the dial and the pointer for maintaining the pointer at the position at which it was set.

6. A centrally located device for maintaining order among a group of players wishing to use a plurality of tennis courts, each of which courts in general becomes available at a different time, comprising: a board; a sloping rack mounted on the board, the rack having paired sloping struts, paired horizontal struts, the spacing of the paired horizontal struts being greater than the maximum transverse dimension of a tennis racket handle, the spacing of the paired sloping struts being larger than the spacing of the paired horizontal struts but smaller than the maximum transverse dimension of a tennis racket head, a plurality of brackets mounting the sloping struts and the horizontal struts to the board, a racket stop mounted between the paired sloping struts for confronting the lowest racket placed within the rack and facilitating its withdrawal, the racket stop having a central plate portion mounted generally perpendicular to the sloping struts for confronting the lowest racket placed within the rack and facilitating its withdrawal, the racket stop having a central plate portion mounted generally perpendicular to the sloping struts, and angled end portions extending angularly away from the central plate in a direction away from a racket placed in the rack; and display means for each court for displaying the time at which the court most recently became occupied and the time at which the court will become available for one of the waiting players.

7. The invention of claim 6 wherein the display means for each court is a plate mounted on the board, the plate having paired dials graduated in time, each dial having a manually settable pointer wherein a player commencing use of the court sets the first pointer to the time at which play is commenced on the court, and the second pointer to the time at which the court will become available for a waiting player, the setting of each being accomplished by the player's manually grasping the pointer and turning it to the desired time indication on the dial.

8. The invention of claim 6 wherein the paired sloping struts are inclined at a angle from the horizontal in the range of 15 degrees to 25 degrees.

9. The invention of claim 6 wherein the paired sloping struts are coated with a frictional coating that prevents a tennis racket placed thereupon from sliding under its own weight while allowing the racket to be pushed down along the sloping struts.

* * * * *